US007090155B1

(12) United States Patent
Rabitsch

(10) Patent No.: US 7,090,155 B1
(45) Date of Patent: Aug. 15, 2006

(54) SPRAY NOZZLE WITH ONE PIECE DIFFUSER UNIT

(76) Inventor: Benjamin Franklin Rabitsch, P.O. Box 598, Millen, GA (US) 30442

( * ) Notice: Subject to any disclaimer, the term of this patent is extended or adjusted under 35 U.S.C. 154(b) by 0 days.

(21) Appl. No.: 10/788,462

(22) Filed: Mar. 1, 2004

(51) Int. Cl.
*B05B 1/04* (2006.01)

(52) U.S. Cl. ..... 239/594; 239/518; 239/521

(58) Field of Classification Search ..... 239/592, 239/589, 593, 594, 595, 597–599, 504, 521, 239/518, 552, 568
See application file for complete search history.

(56) References Cited

U.S. PATENT DOCUMENTS 4,277,029 A 7/1981 Rabitsch
4,648,558 A 3/1987 Rabitsch
4,811,903 A * 3/1989 Okuma et al. ..... 239/284.2
5,076,497 A 12/1991 Rabitsch
6,557,787 B1 * 5/2003 Swan ..... 239/597

* cited by examiner

*Primary Examiner*—Christopher Kim
(74) *Attorney, Agent, or Firm*—Jacobson Holman PLLC

(57) ABSTRACT

A spray nozzle of two piece structure threaded together and including a fitting for mounting on a pressurized liquid supply pipe and including an orifice controlling liquid flow to a one piece molded nozzle of plastic material screw threaded onto the fitting. The nozzle includes spaced longitudinal side walls interconnected by a top wall and a bottom slot. A diffuser plate or blade is mounted between the side walls at the discharge end of the nozzle. The side walls of the nozzle converge from the inlet end of the nozzle toward the nozzle blade or plate at the discharge end. Each side wall converges toward the center line of the nozzle at an angle ranging between 1° and 3°. A thin metal plate forms a closure for a major portion of the length of the bottom slot with a rearward end having an air inlet below the orifice in the fitting to draw air into the nozzle as liquid exits the orifice into a larger volume area at a reduced pressure. The other end of the plate terminates in adjacent but spaced relation to the diffuser blade.

14 Claims, 2 Drawing Sheets

SPRAY NOZZLE WITH ONE PIECE DIFFUSER UNIT

BACKGROUND OF THE INVENTION

1. Field of the Invention

The present invention generally relates to a spray nozzle and more specifically to improvements in the spray nozzle disclosed in my U.S. Pat. No. 5,076,497 issued Dec. 31, 1991. The improved spray nozzle functions in a manner similar to the nozzle disclosed in that patent but includes a novel and unique structure to provide a more effective diffusion pattern of liquid discharge. The improved spray nozzle is a two piece structure screw connected together including a metal fitting connected to and in communication with a pressurized liquid supply pipe and a one piece injection molded plastic nozzle, preferably but not limited to nylon, screw connected to the metal fitting. The nozzle includes laterally spaced longitudinal side walls interconnected by a top wall and open at the bottom to form a continuous bottom slot. The slot extends throughout the length of the nozzle and is provided with a diffuser plate or blade at the discharge end thereof that is integral with the top wall of the nozzle. The inner surfaces of the side walls of the nozzle are vertically parallel and at any given point are spaced equally from a longitudinal center line of the nozzle.

Another significant improvement incorporated into the nozzle of this invention is the longitudinal convergence of the inner surfaces of the side walls from the inlet end of the nozzle toward the diffuser blade or plate at the discharge end. Each side wall converges toward the center line of the nozzle. A further significant improvement of the improved spray nozzle of this invention is to provide interchangeable metal fittings having different size orifices to enable control of the quantity of liquid being discharged by changing metal fittings rather than necessitating that a user have available a supply of one-piece cast spray nozzles in order to control the volume of discharge of liquid into the spray pattern. Likewise interchangeable nozzles are provided having different angles of convergence to vary the spray pattern of the liquid. An angle of convergence ranging between 1° to 3° from a centerline of the nozzle may be provided. A nozzle with the angle of convergence of 2° is preferred when a metal fitting with a smaller orifice is utilized and a nozzle having an angle of convergence of 1° is preferred when a metal fitting with a larger orifice is used. A further significant improvement in the spray nozzle of this invention is the provision of a thin metal insert in the slot in the bottom of the nozzle. The end of the insert adjacent the metal fitting includes an opening in the rearward end directly below the orifice in the metal fitting when the nozzle is assembled onto the metal fitting. The inner surface of the side walls of the nozzle each have a groove receiving the side edges of the metal plate. The outer end of the metal plate terminates adjacent to but in spaced relation of the lower end of the diffuser blade at the discharge end of the nozzle. This structure allows air to be drawn in at the rear of the nozzle for more through mixing of air and liquid as the air and liquid travel through the enclosed area formed by the top wall and side walls of the nozzle and the metal insert in the bottom slot.

2. Description of the Prior Art

The spray nozzle disclosed in my U.S. Pat. No. 5,076,497 is constructed of one piece cast metal and thus includes a fixed diameter orifice or passageway into the nozzle or extension of inverted U-shaped configuration. The spaced vertical wall surfaces in the nozzle are longitudinally parallel and the surfaces must be very smooth in as much as any irregularities in these surfaces adversely affects the flow of liquid in the extension. Therefore, the cast wall surfaces in my prior spray nozzle must be polished or smoothed to remove irregularities formed during the casting process. Smoothing such surfaces is labor intensive and materially adds to the production cost of the nozzle. Additionally, in my prior spray nozzle, the diffuser plate or blade must be secured in place by drilling an aperture and placing a pin therein to secure the blade. Additionally, in order to prevent leakage around the blade where the upper end is slid into a notch in the upper wall of the nozzle, a sealant must be provided at the juncture between the edges of the notch and the surfaces of the blade. This procedure is also labor intensive. In addition, the spray nozzle in my prior patent mentioned above includes an orifice of fixed diameter supplying pressurized liquid to the nozzle thereby requiring the use of different spray nozzles when it is desired to change the volume of liquid in the spray pattern.

SUMMARY OF THE INVENTION

The spray nozzle of this invention includes a diffuser of one piece, injection molded construction having spaced wall surfaces partially open at the bottom and connected at the top in which the wall surfaces are vertically parallel but which longitudinally converge from an inlet end of the nozzle toward the outlet end thereof with the diffuser blade being part of the one piece molded structure. The spray nozzle of this invention also includes a metal fitting having an externally threaded end that screw threadedly engages a supply pipe for pressurized fluid and an internally threaded end receiving and engaging a threaded end of a one piece nozzle. The metal fitting includes flats for engagement by a suitable wrench to secure the fitting in place. The inner end of the one piece nozzle includes a flange which abuts the end of the metal fitting when the nozzle is screw threaded completely into the metal fitting.

A plurality of interchangeable metal fittings are provided which have different sized orifices and which can be selectively assembled with an inner end of the nozzle. Metal fittings having a larger or smaller diameter orifice in the fitting enables different diameter orifices to be used to enable the volume of pressurized liquid supplied to the nozzle to be varied. Thus, rather than requiring that multiple spray nozzles having different size orifices cast therein when being formed be available to change the volume of liquid in a spray pattern, single one-piece plastic nozzle may be converted to different discharge volumes by selecting a metal fitting having an orifice therein of a desired size and assembling the metal fitting and nozzle.

The side wall surfaces of the spray nozzle of this invention converge toward the nozzle blade and are continuous through the inner end of the nozzle. The surfaces of the spaced interior side walls and the interconnecting top portion of the nozzle are smooth throughout their length which results from the molding process thereby reducing production cost. Each inner surface of the side walls includes a longitudinal groove adjacent the lower edge thereof which receives and supports a thin metal plate that extends from a rearward end generally flush with the end of the nozzle to an outer end terminating adjacent to but spaced from a lower end portion of the diffuser blade in the discharge end of the nozzle. The rearward end of the metal plate includes a notch forming an air inlet directly below the orifice in the metal fitting. The side edges of the metal plate engaging the grooves in the inner surfaces of the side walls also maintains the spatial relation between the lower edge of side walls of the nozzle.

This structure provides an expansion zone for the liquid as it enters the nozzle from the orifice in the metal fitting. The expansion zone provides a reduced pressure area to draw air into the flow of liquid downwardly and longitudinally and mixes air molecules into the liquid as it expands immediately after it enters the nozzle. The convergence of the side wall inner surfaces of the nozzle then compresses the air molecules and confines the air molecules and liquid into a more homogenous flow for introducing small air molecules into the liquid being discharged from the nozzle thereby reducing the tendency of liquid droplets to drift when discharged from the nozzle. The specific structure of the converging wall surfaces and entrainment of air molecules into the liquid provides a mixture of air molecules and liquid being discharged which takes advantage of a well known phenomena that liquid and air molecules mixed together are less likely to drift when discharged as a spray thereby producing a more consistent pattern of liquid spray and more consistent application of a known quantity of liquid onto a surface area to which liquid is being applied.

It is an object of the present invention to provide a spray nozzle having a metal fitting attached to a pressurized liquid supply pipe and having a flow control orifice and a one piece molded nozzle of plastic material with spaced wall surfaces connected at the top and open at the bottom forming an inverted U-shaped passageway having a diffuser blade integral with the top connecting wall extending between the outer discharge ends of the wall surfaces. A thin metal plate partially closes the open bottom. The wall surfaces of the nozzle converge longitudinally to the discharge end of the nozzle for entraining air into the liquid and discharging air molecules mixed with liquid to reduce drift of the material being discharged by the nozzle.

Another object of the invention is to provide a spray nozzle in which interchangeable metal fittings having different diameter orifices therethrough are provided to enable the volume of liquid discharged to be controlled.

A further object of the invention is to provide a spray nozzle having a nozzle constructed of molded plastic material in which the wall surfaces are smooth and devoid of irregularities thereby eliminating the necessity of smoothing wall surfaces of a cast metal nozzle.

Still another object of the invention is to provide a spray nozzle in accordance with the preceding objects in which the combination of a selected metal fitting from a group of fittings having different orifice sizes with a nozzle of one size will discharge different volumes of liquid into a spray pattern.

A still further object of the invention is to provide a spray nozzle in accordance with the preceding objects in which the nozzle is screw threadedly engaged with a metal fitting having a selected diameter orifice in which the metal fitting reinforces the end of the nozzle that is screw threaded into the metal fitting.

Yet another object of the invention is to provide a spray nozzle having a one piece molded nozzle including a diffuser blade in the discharge end of the nozzle in which the blade has external side surfaces spaced from the interior of the wall surfaces of the nozzle and a downwardly and inwardly curved leading edge facing the air and liquid mixture flowing through the nozzle for dividing the air and liquid flow into equal discharge paths into the spray pattern.

A still further object of the invention is to provide a spray nozzle in accordance with the preceding objects and to provide a thin metal plate in the open bottom slot between the side walls of the nozzle which includes an air inlet below the orifice in the metal fitting which enables air to be drawn into the nozzle for mixing with liquid and being compressed when moving between said side walls for discharge of a homogenous mixture of air and liquid into a spray pattern.

Other objects and advantages of this invention will become apparent from the following description, taken in connection with the accompanying drawings, wherein is set forth by way of illustration and example, embodiments of this invention.

DESCRIPTION OF THE PREFERRED EMBODIMENTS

Figure 1:
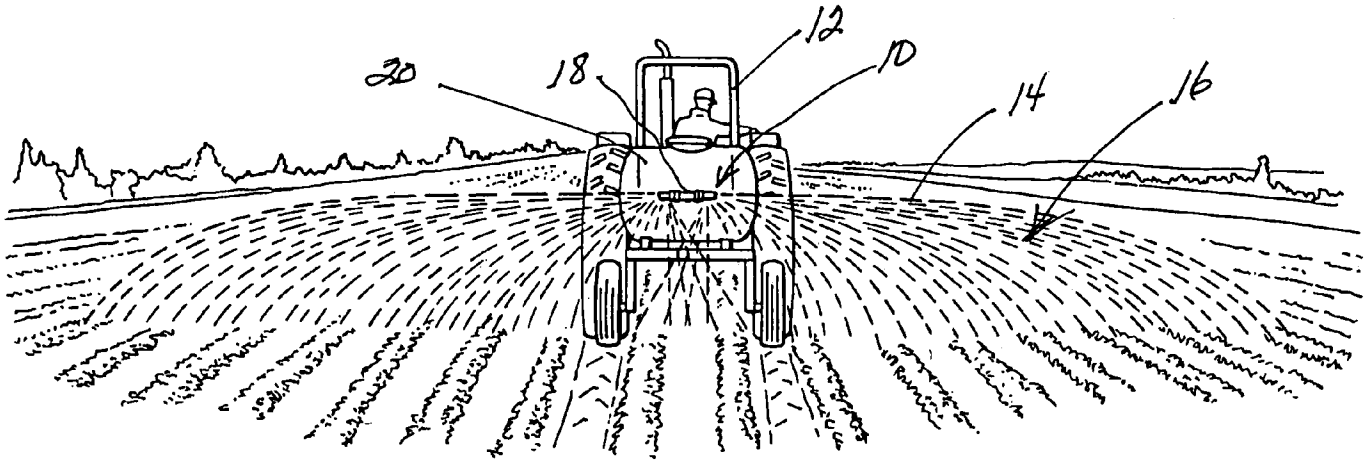
FIG. 1 is a rear schematic elevational view of a spray device illustrating two spray nozzles connected to a pressurized supply pipe in accordance with the present invention for discharging a spray pattern laterally to each side of a vehicle.

Although only one preferred embodiment of the invention is explained in detail, it is to be understood that the invention is not limited in its scope to the details of construction and arrangement of components set forth in the following description or illustrated in the drawings. The invention is capable of other embodiments and of being practiced or carried out in various ways. Also, in describing the preferred embodiment, specific terminology will be resorted to for the sake of clarity. It is to be understood that each specific term includes all technical equivalents which operate in a similar manner to accomplish a similar purpose.

As illustrated in the drawings, a pair of spray nozzles 10 constructed in accordance with the present invention are supported from a vehicle, such as a tractor 12 which, as it moves over the surface of a field, will discharge liquid 14 in a spray pattern generally designated by reference numeral 16. The spray nozzles 10 apply a substantially equal volume of liquid to all areas of the spray pattern 16.

The spray nozzles 10 are connected to a supply pipe or manifold 18 which receives pressurized liquid from a tank 20 by a pump (not shown) at a predetermined pressure. The pair of spray nozzles 10 replace spray booms such as those which extend laterally from a tractor and may have an overall length of 20 feet or more. Such arrangements are difficult to maneuver and include a plurality of longitudinally spaced nozzles on the boom which introduce inequality in the quantity of liquid discharged through the various nozzles located at different distances from the supply pump.

Each spray nozzle 10 of the present invention includes a metal fitting 22 and a nozzle 24. The tubular body 22 is preferably constructed of metal and includes an externally threaded end 26 which may be threaded onto the supply pipe or manifold 18 and includes a liquid passageway 28 that communicates with orifice 30 integral with the central area of the interior of the metal fitting 22. The orifice 30 includes an internal diameter less than the passageway 28 and is defined by an internal flange 32. The other end of the body 22 includes an internally threaded end 34 that extends to the flange 32 with the downstream side of flange 32 defining a shoulder 36 facing the internally threaded end 34 and the passageway 28 and which defines the orifice 30 which provides a controlled volume of liquid flow to nozzle 24. The external surface of the metal fitting 22 is provided with flats 38 for engagement by a wrench to assemble and disassemble the metal fitting 22 in relation to the supply pipe or manifold 18.

Figure 2:
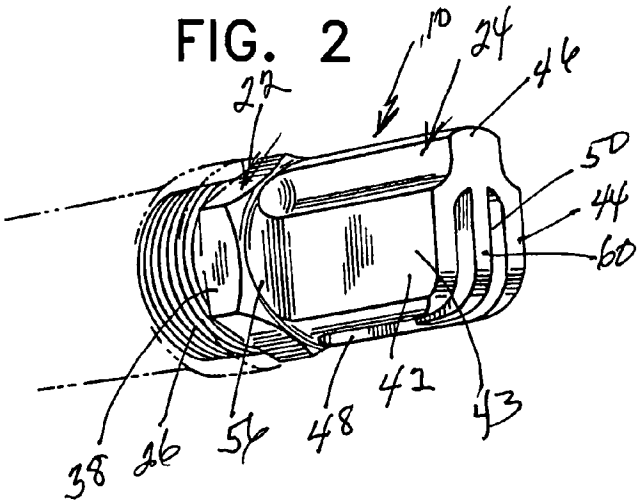
FIG. 2 is a perspective view of the spray nozzle of this invention.
Figure 3:
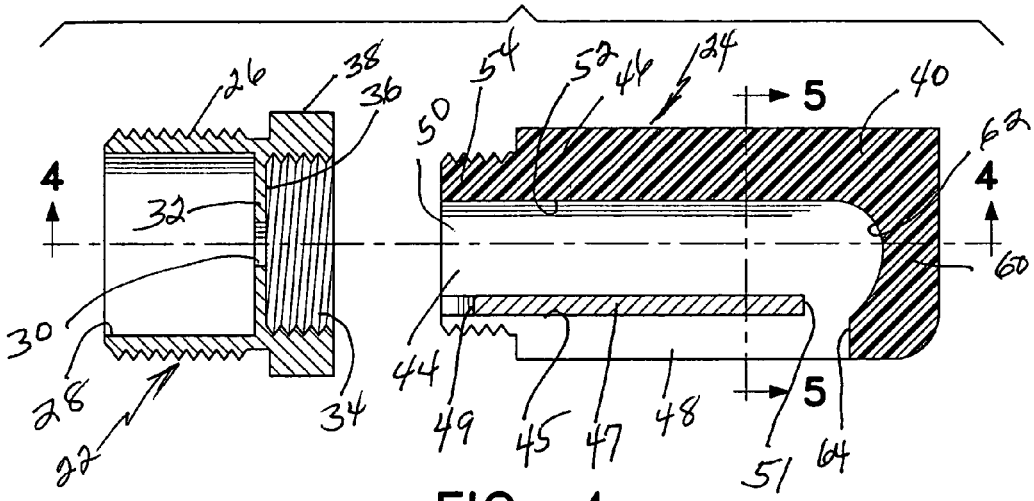
FIG. 3 is an exploded longitudinal sectional view of the components of the spray nozzle of the present invention including a nozzle separated from a metal fitting.

The nozzle 24 includes a body 40 of one piece injection molded plastic, preferably nylon. The body 40 includes a pair of spaced, longitudinally extending side walls 42 and 44 which are interconnected by a top wall 46. The bottom edges of side walls 42 and 44 are separate and spaced from each other to form a slot 48 thus defining a transverse cross-section of inverted U-shape defined by internal surface 50 of side walls 42 and 44 and the U-shaped curve 52 of the inner surface of top wall 46 of the body 40. The end of the body 40 assembled with the metal fitting 22 includes an extension 54 of reduced diameter which is externally threaded and is of cylindrical configuration for screw threaded engagement with the internal threaded end 34 of the metal fitting 22. The extension 54 includes a continuation of the side wall inner surfaces 50 of the nozzle 24. The nozzle 24 includes an external flange 56 integral with the end of the body 40 at its juncture with the extension 54 as illustrated in FIGS. 2 and 3 to reinforce the inner end of the body 40. The flange 56 has a diameter generally equal to the external diameter of the cylindrical end of the metal fitting 22 for abutting engagement therewith. This threaded engagement and abutting engagement between the nozzle 24 and the metal fitting 22 reinforces and rigidities the ends of the walls 42 and 44 and the flange 56 in view of the flat surface to surface contact between flange 56 and the end of metal fitting 22.

Figure 4:
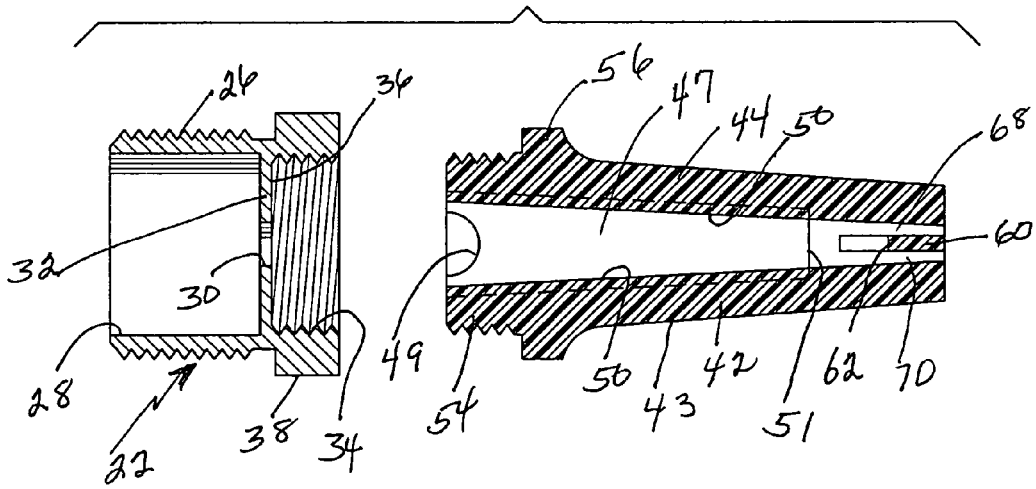
FIG. 4 is a longitudinal sectional view of the spray nozzle illustrated in FIG. 3 taken along section line 4—4 on FIG. 3 illustrating further structural details of the nozzle.
Figure 5:
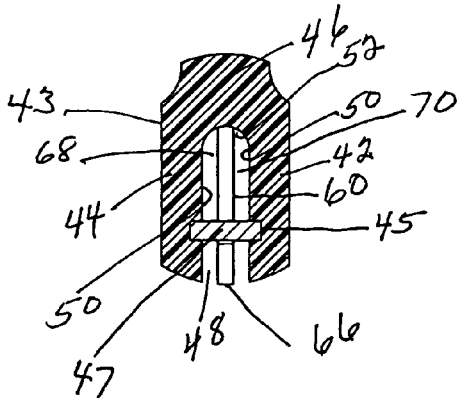
FIG. 5 is a transverse vertical sectional view of the nozzle taken along section line 5—5 on FIG. 3 illustrating the relationship of a thin metal plate in the bottom of the nozzle and the nozzle blade in relation to the interior wall surfaces of the nozzle.

The side walls 42 and 44 include flat outer surfaces 43 that are parallel to inner surfaces 50 defining the inverted U-shaped configuration and are vertically parallel to each other as illustrated in FIG. 5. However, the walls 42 and 44 and wall surfaces 43 and 50 converge longitudinally from the end of the nozzle 24 having extension 54 thereon to the opposite or discharge end as illustrated in FIG. 4. The thickness of the walls 42 and 44 remain substantially the same throughout their length. The walls 42 and 44 preferably converge towards the discharge end of the nozzle at an angle between 1 and 3 degrees in relation to a longitudinal center line of the nozzle 24. This construction of the nozzle 24 facilitates the molding process in view of the opposite taper of walls 42 and 44.

At the discharge end of the nozzle 24, a diffusing plate or blade 60 integral with the top wall 46 of the nozzle 24 is spaced from the inner wall surfaces 50 of the side walls 42 and 44 of the nozzle. The edge of the diffuser blade 60 which faces the metal fitting 22 is curved downwardly at 62 in a generally concave curve with the lower end portion of the curve 62 being less curved and more of an inclined surface 64 to a bottom edge portion 66. The plate or blade 60 is substantially perpendicular to the curve 52 of the top wall 46 of the nozzle 24. This structure provides passageways 68 and 70 between the blade 60 and the inner wall surfaces 50 of the walls 42 and 44 as illustrated in FIGS. 4 and 5 to provide division of the liquid column passing through the nozzle 24 between the inner wall surfaces 50.

The internal diameter of the orifice 30 is of such diameter suited for use with a particular nozzle 24. The diameter of the orifice 30 could range between 0.090 to 1.0 inch depending on the size of the nozzle 24. The lower portion of the converging inner surfaces 50 of the side walls 42 and 44 include shallow longitudinal grooves 45 therein which are in opposed aligned relation. The grooves 45 receive the converging side edges of a thin metal plate 47 that forms a closure for a major portion of the bottom slot 48 and reinforces and rigidifies the lower edge portions of side walls 42 and 44. An inner or rearward end of metal plate 47 terminates flush with the end of threaded extension 54 and includes an arcuate notch 49 directly below the orifice 30 in metal fitting 22. The notch 49 enables air to be drawn into the nozzle 24 for mixing with liquid that is expanding as it moves from the small diameter orifice to the larger area between side walls 42 and 44. The outer end 51 of plate 47 terminates in spaced relation to the diffuser blade 60. The expansion and movement of the liquid produces a reduced pressure area to draw air in through notch 49. As liquid under pressure passes through the orifice 30 into the nozzle 24, some liquid passes downwardly and longitudinally into a reduced pressure zone between side walls 42 and 44. This entrains some air into the liquid passing along the inner surfaces 50 on the walls 42 and 44. The convergence of the wall surfaces 50 exerts inward forces on the liquid and incorporates air molecules into the liquid for passage through the passageways 68 and 70 formed by diffuser blade 60 which additionally diffuses the liquid and air for longitudinal discharge from the nozzle 24. A small portion of the mixed air and liquid is discharged downwardly at the outer end 51 of metal plate 47 into the spray pattern 16. The air molecules entrained with the liquid molecules serve to reduce the drift of liquid molecules from the spray pattern 16 thereby enhancing the integrity of the spray pattern.

When change in the volume of discharge into the spray pattern is desired, rather than assembling a different one-piece, cast metal spray nozzle having a different orifice size onto supply pipe 18, it is only necessary to remove the metal fitting 22 and nozzle 24 from the supply pipe 18, then unscrew the nozzle 24 from the metal fitting 22 and select a metal fitting having a different size orifice. The nozzle 24 is then screw threaded onto the newly selected metal fitting and the assembled spray nozzle is then attached to the supply pipe 18. The nozzle 24 can accommodate metal fittings having several different size orifices as long as the threads in the fitting are the same as the nozzle threads. Alternatively, the nozzle 24 can be unscrewed from the metal fitting while it is attached to the supply pipe after which the metal fitting can be removed and replaced by a metal fitting having a desired different sized orifice. The nozzle 24 can then be screw threaded onto the newly selected metal fitting on the supply pipe 18.

This structure enables various spray patterns and volumes to be obtained by having available a plurality of metal fittings having different orifice sizes rather than having available a plurality of one-piece cast metal spray nozzles having different sized orifices.

While the fitting 22 has been described as a metal fitting, it can also be constructed of a rigid plastic material. Likewise, the metal plate 47 can also be made of plastic material for economy of manufacture.

The foregoing is considered as illustrative only of the principles of the invention. Since numerous modifications and changes will readily occur to those skilled in the art, it is not desired to limit the invention to the exact construction and operation shown and described. Accordingly, all suitable modifications and equivalents may be resorted to, falling within the scope of the invention.

What is claimed is:

1. A spray nozzle for attachment to a supply of pressurized liquid comprising a body having an orifice communicating with a supply of pressurized liquid, a nozzle attached to said body and receiving pressurized liquid therefrom, said nozzle including a pair of longitudinally extending, transversely spaced side walls interconnected by a top wall and open at the bottom to define an inverted U-shaped cross-sectional configuration, said side walls including inner wall surfaces that are substantially vertical, said side walls converging longitudinally from said body to a discharge end of said nozzle, a diffuser blade depending from said top wall oriented in spaced parallel relation to said side walls at a discharge end of said nozzle to define a pair of passageways for discharge of liquid in the form of droplets into a spray pattern, and a thin plate forming a closure for a major portion of the open bottom between said side walls, said plate including an air inlet below said orifice in said body, said plate having an outer end terminating in closely spaced relation to said diffuser blade.

2. The spray nozzle as claimed in claim 1 wherein said body is a fitting, said nozzle being screw threaded to said fitting to enable separation of said nozzle from said fitting and replacement by a fitting having an orifice of a different size.

3. The spray nozzle as claimed in claim 1 wherein said side wall surfaces on said nozzle converge at an angle ranging between 1° and 3.

4. The spray nozzle as claimed in claim 3 wherein said angle of convergence of said side walls is 2°.

5. The spray nozzle as claimed in claim 1 wherein said body is tubular and includes a threaded end to support said body from a liquid supply pipe, the interior of said body including a peripheral inwardly extending flange having a central opening forming said orifice.

6. The spray nozzle as claimed in claim 1 wherein said body includes a threaded end supporting a threaded area at one end of said nozzle to enable separation of said nozzle and body.

7. The spray nozzle as claimed in claim 1 wherein the edge of said diffuser blade facing said body being downwardly curved and having a lower end portion extending toward said body.

8. The spray nozzle as claimed in claim 7 wherein said diffuser blade is integral with said nozzle.

9. A spray nozzle communicating with a supply of pressurized liquid, said spray nozzle comprising a fitting having an orifice therein controlling the rate of liquid flow therethrough, a nozzle attached to said fitting and receiving pressurized liquid passing through said orifice, said nozzle including a pair of longitudinally extending, transversely spaced side walls interconnected by a top wall and an open slot at the bottom to define an inverted U-shaped cross-sectional configuration, said side walls including inner surfaces that are substantially vertical, said inner side wall surfaces converging longitudinally from said fitting to a discharge end of said nozzle, a diffuser blade depending from said top wall and oriented in spaced relation to said side walls to divide said slot into a pair of passageways for discharge of liquid into a spray pattern, a thin plate extending between lower edge portions of said side walls and forming a closure for a major portion of the open slot at the bottom of said side walls, said plate including an air inlet below said orifice in the fitting to enable air being drawn into and mixing with liquid flowing between the side walls and discharged from the nozzle to reduce drift of liquid being discharged into the spray pattern.

10. The spray nozzle as claimed in claim 9 wherein said air inlet is a notch in an end edge of said plate adjacent said fitting, said inner side wall surfaces forming a reduced pressure zone when liquid passes from the orifice into said nozzle, said reduced pressure zone draws air into liquid between the side walls for mixing with the liquid and discharge past said diffuser blade into said spray pattern.

11. The spray nozzle as claimed in claim 10 wherein said plate includes an outer end spaced a short distance from said diffuser blade to enable downward discharge of a small quantity of liquid and air into said spray pattern.

12. The spray nozzle as claimed in claim 11 wherein said side wall inner surfaces on said nozzle converge at an angle ranging between 1° and 3.

13. The spray nozzle as claimed in claim 9 wherein said fitting is tubular and includes a threaded end to support said fitting from a liquid supply pipe, the interior of said fitting including a peripheral inwardly extending flange having a central opening forming said orifice.

14. The spray nozzle as claimed in claim 9 wherein said fitting includes a threaded end supporting a threaded area at one end of said nozzle to enable separation of said nozzle from said fitting thereby enabling fittings having differently sized orifices to be assembled with the same nozzle.

* * * * *